United States Patent [19]

Lanchet

[11] Patent Number: 4,822,287

[45] Date of Patent: Apr. 18, 1989

[54] ELECTRICAL CONNECTOR MODULE INCORPORATING COMPONENTS

[75] Inventor: Lucien Blanchet, Le Vesinet, France

[73] Assignee: Air LB, Colombes, France

[21] Appl. No.: 201,214

[22] Filed: Jun. 2, 1988

[30] Foreign Application Priority Data

Jun. 10, 1987 [FR] France ..... 87 08088

[51] Int. Cl.[4] ..... H01R 23/72

[52] U.S. Cl. ..... 439/76; 361/399

[58] Field of Search ..... 439/76, 620, 688–690, 439/695, 701; 361/395, 399

[56] References Cited

U.S. PATENT DOCUMENTS

| | | | |
|---|---|---|---|
| 3,621,444 | 11/1971 | Stein | 439/689 |
| 4,281,724 | 8/1980 | Kaufman | 361/399 |
| 4,603,930 | 8/1986 | Ito | 439/76 |
| 4,668,873 | 5/1987 | Ohba et al. | 361/395 |
| 4,703,397 | 10/1987 | Minoura et al. | 361/399 |
| 4,723,196 | 2/1988 | Hofmeister et al. | 439/76 |

FOREIGN PATENT DOCUMENTS

| | | |
|---|---|---|
| 2168236 | 8/1973 | France . |
| 2441932 | 6/1980 | France . |
| 2180415 | 3/1987 | United Kingdom . |

*Primary Examiner*—Gary F. Paumen

*Attorney, Agent, or Firm*—Beveridge, De Grandi & Weilacher

[57] ABSTRACT

An electrical connector module comprises an insulative material connector body which is open at the bottom and contains a plurality of female contacts. Male contacts attached to the ends of electrical conductors are received by the female contacts through holes in an upper part of the connector body. Electrical connections are established between the female contacts. The module further comprises at least one component housing open at the bottom adjacent at least one side wall of the connector body, with which it is formed in one piece. A common wall dividing the connector body from the component housing extends a lesser distance in the downward direction than exterior walls of the connector body and the component housing. A printed circuit board carries the female contacts and electrical or electronic components and is inserted into the connector body and the component housing from the bottom, until the part carrying the female contacts is in the connector body and the remainder, which carries the components, is in the component housing. The bottom of the connector body and that of the component housing are closed off below the printed circuit board by a common, selectively attachable and removable base.

8 Claims, 3 Drawing Sheets

ELECTRICAL CONNECTOR MODULE INCORPORATING COMPONENTS

BACKGROUND OF THE INVENTION

1. Field of the invention

The present invention concerns an electrical connector module comprising, in an insulative material connector body, a plurality of female contacts adapted to receive, through holes in the upper part of the body, male contacts attached to the ends of the electrical conductors to be connected, means being provided for establishing electrical connections between the female contacts.

2. Description of the prior art

Connector modules of this kind are well known and are generally designed to be fixed to extruded support rails, for example spring rails as described in French Pat. No. 2 441 932.

These modules are used to interconnect electrical conductors. It is often desirable to insert electrical or electronic components between the conductors, such as fuses, resistors, capacitors, diodes, transistors, etc. Known connector modules are not designed to be able to accommodate any such components, or at best a few small components which have to be incorporated into the modules during manufacture, replacing a number of female contacts. Also, these components have therefore to be incorporated by the manufacturer of the module, which is then supplied completely enclosed to the user. This obviously leads to a high unit cost since each module has to be designed by the manufacturer according to the intended application, so that true mass production is impossible.

An object of the present invention is a module of the kind defined hereinabove adapted to be equipped with a large number of different components by the module user, so as to enable mass production of the modules at reduced unit cost.

SUMMARY OF THE INVENTION

The invention consists in an electrical connector module comprising an insulative material connector body open at the bottom, a plurality of female contacts in said connector body, holes in an upper part of said connector body, male contacts adapted to be attached to the ends of electrical conductors and to be received by said female contacts through said holes, means for establishing electrical connections between said female contacts, at least one component housing open at the bottom thereof and adjacent at least one side wall of said connector body and formed in one place with said connector body, a common wall dividing said connector body from said component housing, exterior walls of said connector body and said component housing, said common wall extending a lesser distance in the downward direction than said exterior walls, a printed circuit board carrying said female contacts and having components thereon, on said printed circuit board being inserted into said connector body and said component housing from said bottom so that the part thereof carrying said female contacts is in said connector body and the remainder thereof carrying said components is in said component housing, and a selectively attachable base adapted to close off the bottom of said connector body and the bottom of said component housing below said printed circuit board.

The combined connector body/component housing and the base designed to close them off at the bottom can be mass produced. The same applies to the printed circuit boards, it being generally sufficient to have a limited number of different models to which the mass produced prefabricated female contacts can be attached. The modules can be supplied to the user prepared in this way, the latter having only to fix the components to the printed circuit board according to the intended application, to insert the printed circuit board assembly into the combined connector module/component housing and close them off at the bottom, below the printed circuit board, using the separate base.

The connector body and the component housing preferably comprise grooves in which the base can slide.

The module preferably further comprises snap-fastener means whereby the base can be locked into a fully engaged position.

The component housing may be closed at the top, in which case it is sealed, but in an alternative and preferred embodiment the component housing is open at the top and comprises means for attaching a separate cover.

This makes it possible to provide access to the components in the module, which may be beneficial, especially where the component compartment contains fuses.

The module preferably comprises ventilation holes in the component housing and/or the cover.

These holes improve the cooling of the components inside the component housing, while protecting these components from accidental contact.

The module may further comprise metal terminals on the printed circuit board for attaching components in a raised position.

The printed circuit board is advantageously held in position relative to the connector body and the component housing not only by the separate base but also by other means, for example snap-fastener retaining means. It is also possible to cast resin underneath the printed circuit board inserted into the combined connector body and component housing, either at the edges of the board only or over all of the board, in which case the bottom of the combined connector body/component housing is sealed.

Various embodiments of a module in accordance with the invention will now be described in more detail by way of illustrative and non-limiting example only with reference to the appended drawings.

DESCRIPTION OF THE PREFERRED EMBODIMENTS

Figure 1:
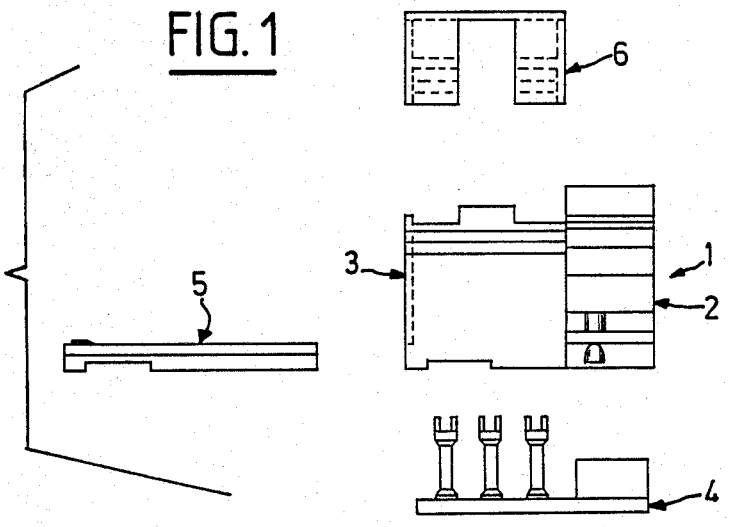
FIG. 1 is an exploded end view of a module in accordance with the invention showing its various component parts.

As shown in the drawings, the electrical connector module in accordance with the invention comprises a double housing 1 formed by two generally parallelepiped-shaped housings 2, 3 adjacent at one longer side and made in one piece from insulative plastics material, namely a connector body 2 and a component housing 3. The module further comprises a printed circuit board 4, a sliding base 5 and a cover 6 that can be attached to the top of the housing 3.

Figure 2:
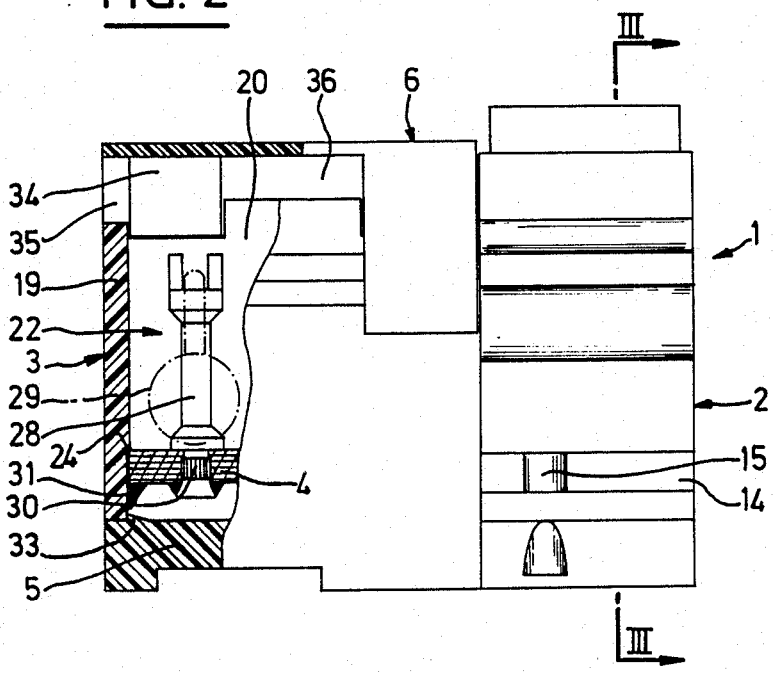
FIG. 2 is a view of the assembled module to a larger scale, partially in cross-section and seen in the same direction as in FIG. 1.
Figure 3:
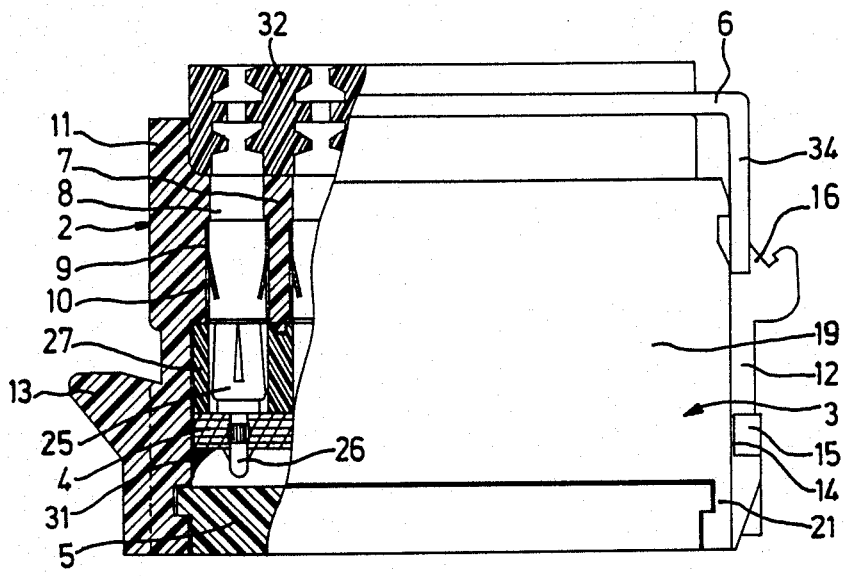
FIG. 3 is a side view partially in cross-section on the line III—III in FIG. 2.

As shown in FIGS. 2 and 3 in particular, the connector body 2 is of generally paralellepiped shape open at the bottom and comprises in its upper wall 7 two rows of holes 8 into which are inserted from below, in the lower part, retaining bushes 9 comprising locking tangs 10. The two opposed front walls 11 and 12 of the connector body 2 carry on the outside (see FIG. 3) means for fixing the module to a supporting rail, namely a boss 13 on the wall 11 and a groove 14 and a boss 15 on the wall 12, for fixing to a spring support rail as described in French Pat. No. 2 441 932.

Also, a label-holder 16 enabling the module to be identified is provided on the outside of the wall 12.

The exterior side wall 17 and the front walls 11 and 12 of the connector body 2 extend down to the bottom of the module, whereas the opposite side wall 18 stops short of the bottom of the module.

The wall 18 also constitutes a common wall separating the connector body 2 and the component housing 3. The opposite exterior side wall 19 of the component housing 3 stops short a little distance from the bottom of the module. The two side walls 18, 19 and the two opposed front walls 20 and 21 define a compartment 22 of parallelepiped shape open at the top and at the bottom.

Figure 4:
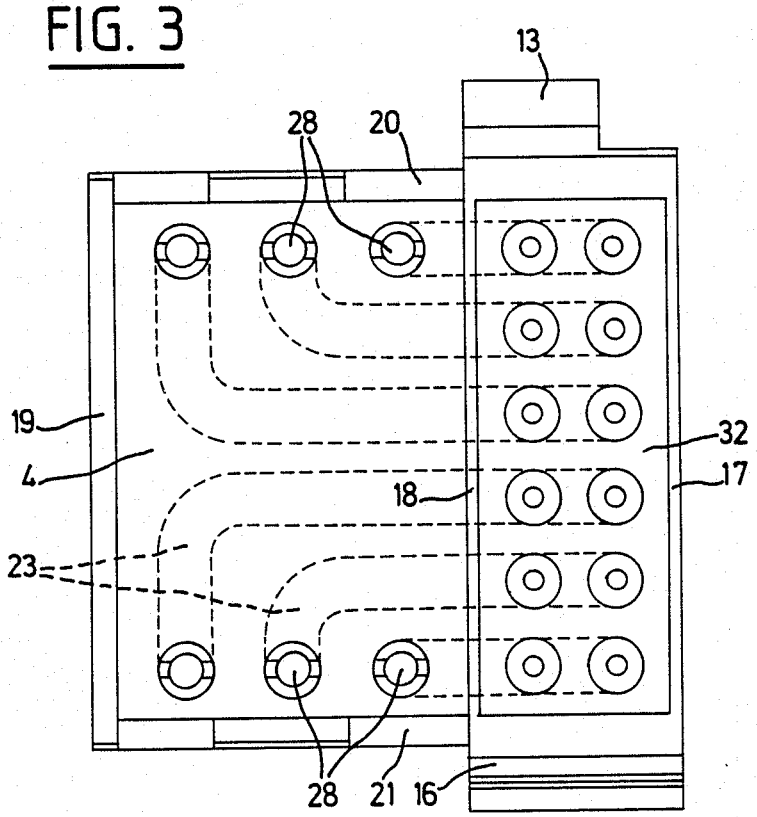
FIG. 4 is a plan view of the module from FIGS. 2 and 3, minus the cover.

The printed circuit board 4 which carries conductive tracks 23 on its lower surface (see FIG. 4) is of a shape and size enabling it to be inserted from below into the double housing 1 below the common separator wall 18, so as to be applied against this wall 18 and against a shoulder 24 provided on the lower surface of the wall 19. The board 4 carries on the upper surface of the part situated inside the connector body 2 two rows of female contacts 25 having tails 26 which pass through the board 4 in order to fix the contact 25 mechanically to the board 4 and to enable the contacts 25 to be electrically connected to the conductive tracks 23 by soldering. The female contacts 25 are surrounded by a block 27 of insulative material. The part of the board 4 inside the component housing 3 carries on its upper surface a number (six in this example) of metal terminals 28 intended to receive, for example, three fuses 29 shown in chain-dotted outline in FIG. 2. The terminals 28 also comprise tails 30 passing through the board 4 for mechanical fixing and electrical connection by soldering to the conductive tracks 23.

The printed circuit board 4 is held in position in the double housing 1 by a bead of resin 31 cast onto the edges of the board 4 underneath the latter.

It will be noted from FIGS. 2 and 3 in particular that the connector body 2 is surmounted by a block 32 of elastic material, through which are holes for the conductors to be connected to pass through, not shown and serving as a gasket to seal the connector body 2.

In the lower part of the double housing 1, that is to say in the part accommodating the board 4, the inside surfaces of the walls 20 and 21 of the component housing 3 are aligned with the inside surfaces of the walls 11 and 12 of the connector body 2. In this area, in each front wall (11, 20 and 12, 21), the double housing 1 comprises a horizontal groove visible in FIG. 3 for receiving, underneath the board 4, the base 5 which is adapted to be slid in like a drawer from the side of the wall 19 of the component housing 3. As shown in FIG. 2, the base 5 comprises at least one snap-fastener notch 33 which locks onto the wall 19 when it is fully engaged in the double housing 1 so as to close off the bottom part of the latter.

The cover 6 is generally U-shaped, each of its two branches 34 being provided with snap-fastener fixing means cooperating with retaining means provided on the walls 20 and 21 of the component housing 3.

FIG. 2 shows clearly how the cover 6, when attached to the top of the component housing 3, leaves ventilation holes 35 improving the cooling of the components 29 inside the compartment 22. Nevertheless, the cover 6 provides good protection against contact with the components 29.

Figure 5:
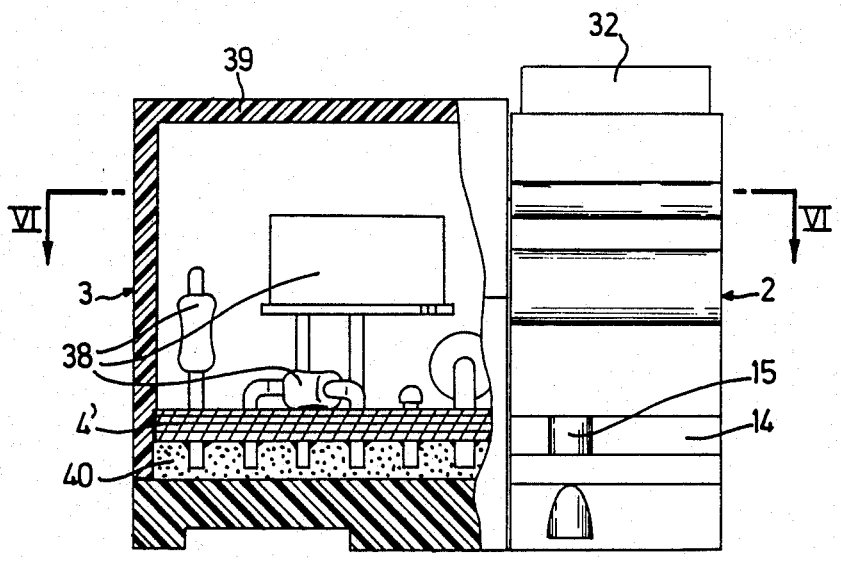
FIG. 5 is an end view, partially in cross-section, of a module in accordance with the invention utilizing another component fixing method.
Figure 6:
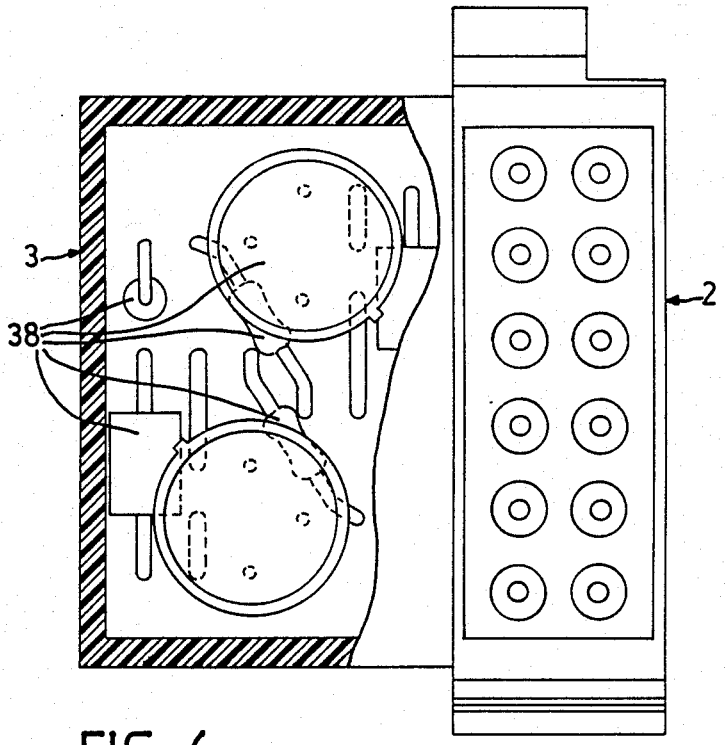
FIG. 6 is a plan view of the module from FIG. 5 partially in cross-section on the line VI—VI in FIG. 5.

The embodiment shown in FIGS. 5 and 6 differs from the embodiment shown in FIGS. 1 through 4 in terms of the design of the connecting tracks on the printed circuit board 4', the components 38 fixed to the board and the fact that the component housing 3 is permanently closed at the top by a top wall 39 joined to the side and front walls of the component housing 3. The components, which may be active or passive components (such as resistors, capacitors, transistors, etc) are in this instance fixed directly to the board 4', their connecting conductors passing through holes provided in the board 4' and being soldered on the lower surface of the board to the conductive tracks which connect to the female contacts provided on the part of the board 4' inside the connector body 2.

To seal the lower part of the module, a layer 40 of resin is cast under the board 4' over all its surface.

It should be noted that it is also possible to cover the components on the board 4, 4' with insulative foam or resin, in which case the module may be sealed even if the component compartment 22 is not sealed, in other words has a separate cover as in FIGS. 1 through 4.

Also, the separate base could be of a non-sliding type and the cover could be fixed in a different way.

To immobilize the printed circuit board 4, 4' in the housing 1 it would be equally possible to extend the tails 26 of the female contacts 25 so that their ends came into contact with the base 5 so that it would therefore be the base 5 which held the board in position, in addition to or instead of the resin 31, 40 and/or any snap-fastener means.

It should also be noted that instead of producing a module combining a connector body 2 and a component housing 3, as shown, it would be equally feasible to produce a module comprising two connector bodies 2 with a component housing 3 between them, or a module comprising a connector body 2 flanked by a component housing 3 on each side.

The modules in accordance with the invention preferably have a width which is equal to a multiple of the width of the modules ordinarily employed.

I claim:

1. Electrical connector module comprising an insulative material connector body open at the bottom, a plurality of female contacts in said connector body, holes in an upper part of said connector body, male contacts adapted to be attached to the ends of electrical conductors and to be received by said female contacts through said holes, means for establishing electrical connections between said female contacts, at least one component housing open at the bottom thereof and adjacent at least one side wall of said connector body and formed in one piece with said connector body, a common wall dividing said connector body from said component housing, exterior walls of said connector body and said component housing, said common wall extending a lesser distance in the downward direction than said exterior walls, a printed circuit board carrying said female contacts and having components thereon, on said printed circuit board being inserted into said connector body and said component housing from said bottom so that the part thereof carrying said female contacts is in said connector body and the remainder thereof carrying said components is in said component housing, and a selectively attachable base adapted to close off the bottom of said connector body and the bottom of said component housing below said printed circuit board.

2. Module according to claim 1, wherein said connector body and said component housing comprise grooves in which said base can slide.

3. Module according to claim 2, further comprising snap-fastener means whereby said base can be locked into a fully engaged position.

4. Module according to claim 1, further comprising a separate cover for said component housing and wherein said component housing is open at the top and comprises means for attaching said cover.

5. Module according to claim 4, comprising ventilation holes in said component housing and/or said cover.

6. Module according to claim 1, further comprising metal terminals on said printed circuit board for attaching components in a raised position.

7. Module according to claim 1, further comprising snap-fastener means for holding said printed circuit board in position relative to said connector body and said component housing.

8. Module according to claim 1, wherein said printed circuit board is held in position relative to said connector body and said component housing by means of a resin cast underneath at the least the edges of said printed circuit board.

* * * * *